US010684568B2

(12) United States Patent
Hara et al.

(10) Patent No.: US 10,684,568 B2
(45) **Date of Patent: *Jun. 16, 2020**

(54) REVERSIBLY ALLOCHROIC TONER, METHOD OF PRODUCING THE SAME, TONER CARTRIDGE, AND IMAGE FORMING APPARATUS

(71) Applicant: Toshiba Tec Kabushiki Kaisha, Tokyo (JP)

(72) Inventors: Takafumi Hara, Nagaizumi Shizuoka (JP); Masahiro Ikuta, Mishima Shizuoka (JP); Tsuyoshi Itou, Izunokuni Shizuoka (JP); Yasuhito Noda, Mishima Shizuoka (JP); Kazuhisa Takeda, Kannami Shizuoka (JP); Takayasu Aoki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/283,171

(22) Filed: Feb. 22, 2019

(65) Prior Publication Data

US 2019/0187578 A1 Jun. 20, 2019

Related U.S. Application Data

(63) Continuation of application No. 15/346,097, filed on Nov. 8, 2016, now abandoned, which is a (Continued)

(51) Int. Cl.

| | |
|---|---|
| ***G03G 9/09*** | (2006.01) |
| ***G03G 9/08*** | (2006.01) |
| ***G03G 9/087*** | (2006.01) |
| ***G03G 9/107*** | (2006.01) |
| ***G03G 9/113*** | (2006.01) |

(52) U.S. Cl.
CPC ..... *G03G 9/0928* (2013.01); *G03G 9/0804* (2013.01); *G03G 9/0819* (2013.01); (Continued)

(58) Field of Classification Search
CPC ..... G03G 9/0928; G03G 9/0926
See application file for complete search history.

(56) References Cited

U.S. PATENT DOCUMENTS 4,720,301 A 1/1988 Kito et al.
7,794,631 B2 9/2010 Fujita
(Continued)

OTHER PUBLICATIONS

Final Office Action on U.S. Appl. No. 15/346,097 dated Nov. 27, 2018.

(Continued)

*Primary Examiner* — Thorl Chea
(74) *Attorney, Agent, or Firm* — Foley & Lardner LLP

(57) ABSTRACT

A reversibly allochroic toner contains a binder resin and a colorant. The colorant reversibly switches between first and second color states in response to temperature changes. The colorant exhibits a hysteresis in a temperature-color state curve thereof in which the following relationships are satisfied.

$$Tr<T_{L2}<T_{L1}<T_{H1}<T_{H2}<Tg$$

$$T_{H2}\leq 50°\ C.$$

$$20°\ C.\leq Tr\leq 30°\ C.$$

where, $T_{H1}$ is a temperature at which the colorant starts to change from the first color state to the second color state, $T_{H2}$ is a temperature at which the colorant completely changes to the second color state, $T_{L1}$ is a temperature at which the colorant starts to change from the second color state to the first color state, $T_{L2}$ is a (Continued)

temperature at which the colorant completely changes to the first color state, and Tg is a glass transition temperature of the binder resin.

23 Claims, 4 Drawing Sheets

Related U.S. Application Data continuation of application No. 14/452,400, filed on Aug. 5, 2014, now Pat. No. 9,519,236.

(52) U.S. Cl.
CPC ..... *G03G 9/08755* (2013.01); *G03G 9/0926* (2013.01); *G03G 9/1075* (2013.01); *G03G 9/1136* (2013.01)

(56) References Cited

U.S. PATENT DOCUMENTS

| | | | |
|---|---|---|---|
| 8,222,183 | B2 | 7/2012 | Ono |
| 9,519,236 | B2 | 12/2016 | Hara et al. |
| 2010/0209839 | A1 | 8/2010 | Kabai et al. |
| 2013/0029257 | A1 | 1/2013 | Fujita et al. |

OTHER PUBLICATIONS

Non-Final Office Action on U.S. Appl. No. 15/346,097 dated Jun. 28, 2018.
U.S. Notice of Allowance on U.S. Appl. No. 14/452,400 dated Aug. 18, 2016.
U.S. Office Action on U.S. Appl. No. 14/452,400 dated Feb. 3, 2016.
U.S. Office Action on U.S. Appl. No. 14/452,400 dated Jun. 23, 2016.

FIG. 4

| | COLOR-ANT DISPER-SION | COLORANT | | | | | | | |
|---|---|---|---|---|---|---|---|---|---|
| | | COMPONENT (c1) 2 PARTS BY MASS ELECTRON-DONATING COLORABLE ORGANIC COMPOUND | COMPONENT (c2) 8 PARTS BY MASS ELECTRON-ACCEPTING COMPOUND | COMPONENT (c3) 50 PARTS BY MASS REACTION MEDIUM | $T_{L2}$ (°C) | $T_{L1}$ (°C) | $T_{H1}$ (°C) | $T_{H2}$ (°C) | $T_{H1}-T_{L1}$ $\Delta T$ (°C) |
| EXAMPLE 1 | (C−1) | 3-(4-DIETHYLAMINO-2-HEXYLOXYPHENYL)-3-(1-ETHYL-2-METHYLINDOL-3-YL)-4-AZAPHTHALIDE | 1,1-BIS(4-HYDROXYPHENYL) HEXAFLUOROPROPANE<br>1,1-BIS(4-HYDROXYPHENYL) n-DECANE | PALMITIC ACID-n-OCTYL | 27 | 28 | 33 | 34 | 5 |
| EXAMPLE 2 | (C−2) | | | PALMITIC ACID-n-HEPTYL | 28 | 30 | 33 | 34 | 3 |
| COMPAR-ATIVE EXAMPLE 1 | (C−3) | | | CAPRYLIC ACID-4-BENZYLOXYPHENYLETHYL | −20 | 0 | 70 | 92 | 70 |

REVERSIBLY ALLOCHROIC TONER, METHOD OF PRODUCING THE SAME, TONER CARTRIDGE, AND IMAGE FORMING APPARATUS

CROSS REFERENCE TO RELATED APPLICATIONS

This application is a continuation of U.S. patent application Ser. No. 15/346,097 filed Nov. 8, 2016 which application is a continuation of U.S. patent application Ser. No. 14/452,400 filed Aug. 5, 2014, the entire contents of which are incorporated herein by reference in their entireties.

FIELD

Embodiments described herein relate generally to a reversibly allochroic toner, a method of producing the same, a toner cartridge, and an image forming apparatus.

BACKGROUND

Some of the images obtained by fixing a toner on a recording medium, such as paper, can reversibly switch between a chromogenic state and an achromatized state in response to temperature changes.

To achieve this effect in the related art, a toner containing a colorant which exhibits a hysteresis in a temperature-color state curve thereof, is used.

However, for the toner containing a colorant which exhibits the hysteresis, the temperature condition needs to be controlled, such that the state of the colorant does not change from the chromogenic state to the achromatized state at the time of producing the toner or at the time of fixing the toner to form the image.

Moreover, in the case of the image obtained by the toner, if an attempt is made to cause the image, which is in the achromatized state, to produce a color, the image has to be kept at a low temperature such as a temperature lower than 0° C. for a long time in some cases.

BRIEF DESCRIPTION OF THE DRAWINGS

FIG. 4 shows the composition of colorants used for toners according to embodiments and comparative examples.

DETAILED DESCRIPTION

Figure 1:
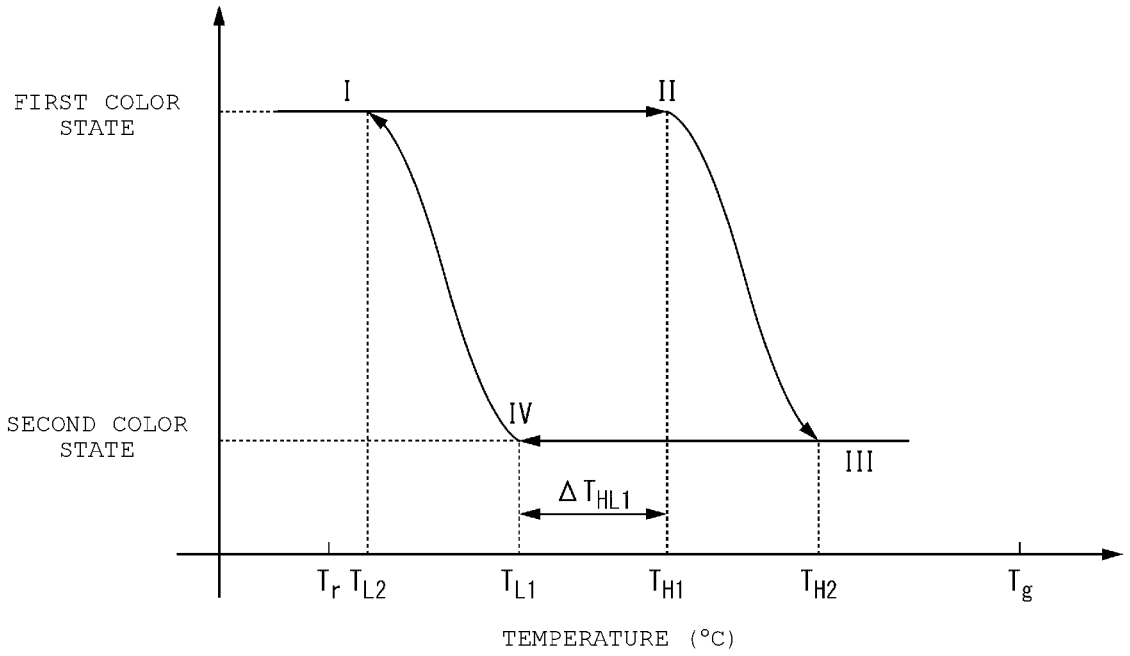
FIG. 1 is a temperature-color state curve of a colorant used in a reversibly allochroic toner according to an embodiment.

Embodiments provide a reversibly allochroic toner that can form an image having a color that reversibly changes when a temperature change occurs at a temperature higher than 20° C., a method of producing the same, a toner cartridge, and an image forming apparatus.

First Embodiment

A reversibly allochroic toner (hereinafter, simply referred to as "toner" in some cases) according to a first embodiment contains a binder resin and a colorant.

The state of the colorant reversibly switches between a first color state and a second color state in accordance with a temperature change. Moreover, the colorant exhibits a hysteresis in a temperature-color state curve thereof.

According to the temperature-color state curve of the colorant, when the colorant is in the first color state, and the temperature keeps increasing and reaches a temperature $T_{H1}$ (° C.), the colorant starts to change to the second color state, and in a temperature region in which the temperature is equal to or higher than a temperature $T_{H2}$ (° C.) which is higher than the temperature $T_{H1}$ (° C.), the colorant completely changes to the second color state. Then, when the colorant is in the second color state, and the temperature keeps decreasing and reaches a temperature $T_{L1}$ (° C.), the colorant starts to change to the first color state, and in a temperature region in which the temperature is equal to or lower than a temperature $T_{L2}$ (° C.) which is lower than the temperature $T_{L1}$ (° C.), the colorant completely changes to the first color state.

In the temperature-color state curve, the relationship of the following Formulae (1), (2), and (3) is satisfied. In Formula (1), Tg indicates the glass transition temperature (° C.) of the binder resin.

$$Tr<T_{L2}<T_{L1}<T_{H1}<T_{H2}<Tg \quad \text{Formula (1)}$$

$$T_{H2}\leq 50^\circ\ C. \quad \text{Formula (2)}$$

$$20^\circ\ C.\leq Tr\leq 30^\circ\ C. \quad \text{Formula (3)}$$

Hereinafter, the reversibly allochroic toner according to the an embodiment will be described.

The reversibly allochroic toner according to the embodiment contains a binder resin and a colorant.

The glass transition temperature (Tg) of the binder resin used for the reversibly allochroic toner exceeds 50° C. From the viewpoints of the comparability between the low-temperature fixability and storage stability of the toner, Tg is preferably 55° C. or higher but lower than 65° C. If Tg of the binder resin is lower than 50° C., while excellent low-temperature fixability is easily obtained, the storage stability becomes poor. If Tg of the binder resin is 65° C. or higher, while the storage stability is improved, the low-temperature fixability becomes poor.

In the present specification, the glass transition temperature (Tg) of a resin represents a value that is measured by differential scanning calorimetry or the like. For example, the glass transition temperature (Tg) can be measured by, for example, the following method. By using a DSC (DSC Q2000, manufactured by TA Instruments of Japan), Tg is measured under the conditions of a sample: 5 mg, lid and pan: alumina, temperature increasing rate: 10° C./min, and measurement temperature: 20° C. to 200° C. The sample heated to 200° C. is cooled to 20° C. or a lower temperature, and then the sample is heated once more. The temperature measured in this manner is taken as data. In a peak curve that appears near 30° C. to 60° C., a tangent of the edge of the low-temperature side and a tangent of the edge of the high-temperature side are drawn, and a point of intersection of the extensions of both the tangents is determined as Tg.

The average molecular weight (Mw) of the binder resin is preferably 5,000 to 70,000, and more preferably 10,000 to 30,000. If Mw of the binder resin is less than the preferable lower limit, the heat-resistant storability of the toner becomes poor. Meanwhile, the greater the Mw of the binder resin is, the higher the fixing temperature becomes. Accordingly, if Mw of the binder resin exceeds the preferable upper limit, it is not preferable from the viewpoint of suppressing energy consumption in the fixing process.

In the present specification, the average molecular weight (Mw) of a resin represents a value that is obtained by gel permeation chromatography and expressed in terms of polystyrene.

Examples of the binder resin include styrene-based resins such as polystyrene, styrene-butadiene copolymers, and styrene-acrylic acid copolymers; ethylene-based resins such as polyethylene, polyethylene-vinyl acetate copolymers, polyethylene-norbornene copolymers, and polyethylene-vinyl alcohol copolymers; polyester resins; acrylic resins; phenol-based resins; epoxy-based resins; allylphthalate-based resins; polyamide-based resins; and maleic acid-based resins.

One type of the binder resin may be used by itself, or two or more types thereof may be used in combination.

Among the above binder resins, polyester resins and styrene-based resins are preferable since these resins have a low glass transition temperature and exhibit excellent low-temperature fixability, and of the two, polyester resins are more preferable. Among the polyester resins, those having an acid value of 0.5 mg KOH/g to 30 mg KOH/g are preferable.

The content of the binder resin in the reversibly allochroic toner is preferably 30% by mass to 90% by mass based on the total amount of the toner (excluding an external additive which will be described later). If the content of the binder resin is less than the preferable lower limit, fixability and fastness of the image are not easily secured. If the content of the binder resin exceeds the preferable upper limit, fixability is not easily secured.

In the colorant used for the reversibly allochroic toner according to the embodiment, the colorant reversibly switches between the first color state and the second color state according to temperature changes, and the colorant exhibits a hysteresis in a temperature-color state curve thereof.

The "colorant exhibits a hysteresis in a temperature-color state curve thereof" means that when the temperature is increased or decreased within a certain range, a closed curve is formed in the temperature-color state curve.

FIG. 1 shows a temperature-color state curve of the colorant used for the reversibly allochroic toner according to the embodiment.

In FIG. 1, the abscissa represents the temperature (° C.), and the ordinate represents the color state of the toner. The color state of the toner changes in the direction of the arrow in response to temperature changes. As used herein, the "change of the color state" means that at least one of "brightness", "color hue", and "chroma" changes. That is, the first color state differs from the second color state, in terms of at least one of the "brightness", "color hue", and "chroma". When the color state of toner is an "achromatized" state, this means that an image formed with such a toner has a color that is different from the base color of paper, and is not visually perceptible.

In FIG. 1, $T_{H1}$ is a temperature (° C.) at which the colorant starts to change from the first color state to the second color state. $T_{H2}$ is a temperature (° C.) at which the colorant completely changes to the second color state. $T_{L1}$ is a temperature (° C.) at which the colorant starts to change from the second color state to the first color state. $T_{L2}$ is a temperature (° C.) at which the colorant completely changes to the first color state. Tg is a glass transition temperature (° C.) of the binder resin.

Among the temperatures $T_{H1}$, $T_{H2}$, $T_{L1}$, $T_{L2}$, and Tg, the relationship of the following Formulae (1), (2), and (3) is satisfied.

$$Tr<T_{L2}<T_{L1}<T_{H1}<T_{H2}<Tg \quad \text{Formula (1)}$$

$$T_{H2}\leq 50^\circ\ C. \quad \text{Formula (2)}$$

$$20^\circ\ C.\leq Tr\leq 30^\circ\ C. \quad \text{Formula (3)}$$

In FIG. 1, $\Delta T_{HL1}$ means a difference between the temperature $T_{H1}$ and the temperature $T_{L1}$. I, II, III, and IV indicate the color state respectively. I is a region of a temperature equal to or lower than the temperature $T_{L2}$ (° C.) in which the colorant is completely in the first color state. II is a point at which the temperature that is kept increasing reaches the temperature $T_{H1}$ (° C.), and the colorant starts to change from the first color state to the second color state. III is a region of a temperature equal to or higher than the temperature $T_{H2}$ (° C.) in which the colorant is completely in the second color state. IV is a point at which the temperature that is kept decreasing reaches the temperature $T_{L1}$ (° C.), and the colorant starts to change from the second color state to the first color state.

In the temperature-color state curve shown in FIG. 1, when the colorant is in the first color state (I), and the temperature keeps increasing, when the temperature reaches the temperature $T_{H1}$ (° C.), the colorant starts to change from the first color state to the second color state (II). Thereafter, in the region of temperature equal to or higher than the temperature $T_{H2}$ (° C.) which is higher than the temperature $T_{H1}$ (° C.), the colorant completely changes to the second color state (III).

When the colorant is in the second color state (III), and the temperature keeps decreasing, when the temperature reaches the temperature $T_{L1}$ (° C.), the colorant starts to change from the second color state to the first color state (IV). Thereafter, in the region of temperature equal to or lower than the temperature $T_{L2}$ (° C.) which is lower than the temperature $T_{L1}$ (° C.), the colorant completely changes to the first color state (I).

The temperature $T_{H2}$ is 50° C. or lower (Formula (2)), preferably lower than 45° C., more preferably lower than 40° C., and even more preferably higher than 33° C. but equal to or lower than 35° C. If the temperature $T_{H2}$ exceeds 50° C., it is hard to cause the colorant in the first color state to completely change to the second color state by a simple method such as a method of utilizing body temperature and the like, and a heat source, frictional heat, and the like are required. It is not preferable to use a heat source, frictional heat, and the like since the recording medium such as paper and the image portion may deteriorate. For example, in order to change the color state of an image by using a method of causing the image portion to be pressed by a finger (use of body temperature), it is preferable for the temperature $T_{H2}$ to be lower than 40° C.

The temperature Tr is 20° C. to 30° C. (Formula (3)), preferably 23° C. to 27° C., and particularly preferably 25° C. The temperature $T_{L2}$ is higher than 20° C., preferably higher than 25° C., more preferably higher than 25° C. but lower than 30° C., even more preferably 26° C. to 29° C., and particularly preferably 27° C. to 28° C. If the temperature Tr is equal to or higher than the lower limit of the range, and the temperature $T_{L2}$ is higher than the lower limit of the range, the colorant can reversibly switch between the first color state and the second color state by a simple temperature control method.

The temperature $T_{H2}$ is lower than the glass transition temperature (Tg) of the binder resin. If the temperature $T_{H2}$ is equal to or higher than the Tg, it is not preferable since a heat source, frictional heat, and the like are required to cause the colorant in the first color state to completely change to the second color state, and the recording medium and the image portion may deteriorate.

The difference ($\Delta T_{HL1}$) between the temperature $T_{H1}$ and the temperature $T_{L1}$ is preferably 7° C. or lower (Formula (4)). If $\Delta T_{HL1}$ is 7° C. or lower, the colorant easily switches between the first color state and the second color state. If $\Delta T_{HL1}$ is 3° C. or lower, the colorant more easily and rapidly switches between the first color state and the second color state. If $\Delta T_{HL1}$ is 4° C. to 7° C., the colorant slowly switches between the first color state and the second color state, whereby the behavior of color change can be more easily confirmed visually.

As the colorant used for the reversibly allochroic toner, a composition is preferable which contains a component (c1) which is an electron-donating colorable organic compound, a component (c2) which is an electron-accepting compound, and a component (c3) which is a reaction medium controlling the color reaction between the component (c1) and the component (c2).

The component (c1) (electron-donating colorable organic compound) is an electron-donating compound that can produce color by reacting with the component (c2), and typical examples of the component thereof include leuco dyes.

Examples of the component (c1) include phthalides, azaphthalides, fluorans, styrylinoquinolines, diazarhodamine lactones, pyridine-based compounds, pyrimidine-based compounds, quinazoline-based compounds, bisquinazoline-based compounds, and the like. Examples of the phthalides include diphenylmethane phthalides, phenylindolyl phthalides, indolylphthalides, and the like. Examples of the azaphthalides include diphenylmethane azaphthalides, phenylindolyl azaphthalides, and the like.

Specific examples of the component (c1) include phthalides such as 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide; azaphthalides such as 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, and 3-(4-diethylamino-2-hexyloxyphenyl)-3-(1-ethyl-2-methylindol-3-yl)-4-azaphthalide; fluorans such as 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, and 1,2-benz-6-(N-ethyl-N-isoamylamino)fluoran; styrylinoquinolines such as 2-(3-methoxy-4-dodecoxystyryl)quinoline; and pyrimidine-based compounds such as spiro[5H-(1)benzopyrano(2,3-d)pyrimidine-5,1' (3'H)isobenzofuran]-3'-one, 2-(diethylamino)-8-(diethylamino)-4-methyl, spiro[5H-(1)benzopyrano(2,3-d)pyrimidine-5,1' (3'H)isobenzofuran]-3'-one, 2-(di-n-butylamino)-8-(di-n-butylamino)-4-methyl, spiro[5H-(1)benzopyrano(2,3-d)pyrimidine-5,1' (3'H)isobenzofuran]-3'-one, 2-(di-n-butylamino)-8-(diethylamino)-4-methyl, spiro[5H-(1)benzopyrano(2,3-d)pyrimidine-5,1' (3'H)isobenzofuran]-3'-one, 2-(di-n-butylamino)-8-(N-ethyl-N-i-amylamino)-4-methyl, spiro[5H-(1)-benzopyrano(2,3-d)pyrimidine-5,1'(3'H)isobenzofuran]-3'-one, and 2-(di-n-butylamino)-8-(di-n-butylamino)-4-phenyl.

One type of the component (c1) may be used by itself, or two or more types thereof may be used concurrently.

Among the components (c1) described above, azaphthaldes are preferable since these are highly reactive with the component (c2).

The content of the component (c1) in the composition containing the components (c1) to (c3) is preferably 1% by mass to 10% by mass based on the total amount of the components (c1) to (c3).

The component (c2) is an electron-accepting compound that gives a proton to the component (c1) (a compound that receives an electron from the component (c1)).

Specific examples of the component (c2) include phenols such as monophenols and polyphenols; phenol metal salts; carboxylic acid metal salts; aromatic carboxylic acids or esters thereof; aliphatic carboxylic acids having 2 to 5 carbon atoms; acetophenones; benzophenones; sulfonic acid; sulfonate; phosphoric acids; phosphoric acid metal salts; acidic phosphoric acid esters; acidic phosphoric acid ester metal salts; phosphorous acids; phosphorous acid metal salts; triazole and derivatives thereof; bisphenol; trisphenol; a phenol and aldehyde condensation resin; the above compounds having substituents; and the like.

Examples of the substituent that the above compounds have include an alkyl group, an aryl group, an acyl group, an alkoxycarbonyl group, a hydroxy group, a carboxy group or an ester group thereof, an amide group, a halogen group, and the like.

Specific examples of the component (c2) include phenols such as phenol, o-cresol, tert-butylcatechol, nonylphenol, n-octylphenol, n-dodecylphenol, n-stearylphenol, p-chlorophenol, p-bromophenol, o-phenylphenol, resorcin, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, and 4,4'-[1,4-phenylenebis(1-methylethylidene)bis(benzene-1,2,3-triol)]; aromatic carboxylic acids or esters thereof such as n-butyl p-hydroxybenzoate, n-octyl p-hydroxybenzoate, benzyl p-hydroxybenzoate, dihydroxybenzoate or an ester thereof (for example, 2,3-dihydroxybenzoate or methyl 3,5-dihydroxybenzoate), gallic acid, dodecyl gallate, ethyl gallate, butyl gallate, and propyl gallate; bisphenols such as 2,4'-biphenol, 4,4'-biphenol, 4,4'-(1-methylethylidene)bisphenol, 4,4'-[1,4-phenylenebis(1-methylethylidene)bis(1,2-benzenediol)], 2,2'-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl)ethylpropionate, 2,2-bis(4-hydroxyphenyl)-4-methylpentane, 2,2-bis(4-hydroxyphenyl)hexafluoropropane, 1,1-bis(4-hydroxyphenyl)hexafluoropropane, 2,2-bis(4-hydroxyphenyl)n-heptane, and 2,2-bis(4-hydroxyphenyl)n-nonane; trisphenols such as 4,4',4"-ethylidenetrisphenol and methylenetris-p-cresol; acetophenones such as 2,4-dihydroxyacetophenone, 2,5-dihydroxyacetophenone, 2,6-dihydroxyacetophenone, 3,5-dihydroxyacetophenone, and 2,3,4-trihydroxyacetophenone; benzophenones such as 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, and 2,3,4,4'-tetrahydroxybenzophenone; and the like.

One type of the component (c2) may be used by itself, or two or more types thereof may be used concurrently.

Among the components (c2) described above, bisphenols are preferable since these are highly reactive with the component (c1).

The content of the component (c2) in the composition containing the components (c1) to (c3) is preferably 5% by mass to 20% by mass based on the total amount of the components (c1) to (c3).

The component (c3) is a reaction medium controlling the color reaction between the component (c1) and the component (c2).

As the reaction medium, a known compound can be used as long as it can change color by hindering the color reaction between the component (c1) and the component (c2) by heat. Particularly, the allochroic mechanism utilizing known temperature hysteresis, which is disclosed in JP-A-60-264285, JP-A-2005-1369, JP-A-2008-280523, and the like, is excellent.

Examples of the known component (c3) that is disclosed in the above documents and can cause temperature hysteresis include alcohols, esters, ketones, ethers, acid amides, and the like. Among these, esters are preferable as the component (c3).

Examples of the esters include carboxylic acid esters having a substituted aromatic ring, esters of carboxylic acid having an unsubstituted aromatic ring and aliphatic alcohol, esters of carboxylic acid having an unsubstituted aromatic ring and aromatic alcohol, carboxylic acid esters having a cyclohexyl group in the molecule, esters of fatty acid and unsubstituted aromatic alcohol, esters of fatty acid and phenol, esters of fatty acid and aliphatic alcohol, esters of dicarboxylic acid and aromatic alcohol, esters of dicarboxylic acid and branched aliphatic alcohol, and the like.

Specific examples of the component (c3) include esters of carboxylic acid having an unsubstituted aromatic ring, such as dibenzyl cinnamate, and aromatic alcohol; esters of fatty acid and linear aliphatic alcohol, such as palmitic acid-n-heptyl, palmitic acid-n-octyl, heptyl stearate, didecyl adipate, dilauryl adipate, dimyristyl adipate, diacetyl adipate, and distearyl adipate; esters of fatty acid and branched aliphatic alcohol, such as trilaurin, trimyristin, tristearin, dimyristin, and distearin; and the like.

One type of the component (c3) may be used by itself, or two or more types thereof may be used concurrently.

Among the components (c3) described above, esters of fatty acid and aliphatic alcohol are preferable since the behavior similar to the temperature-color state curve shown in FIG. 1 is easily obtained. Among the esters, esters of fatty acid and linear aliphatic alcohol are particularly preferable.

The content of the component (c3) in the composition containing the components (c1) to (c3) is preferably 70% by mass to 94% by mass based on the total amount of the components (c1) to (c3).

If necessary, the composition containing the components (c1) to (c3) may contain optional components other than the components (c1) to (c3).

One type of the colorant may be used by itself, or two or more types thereof may be used concurrently.

Among the colorants, the composition containing the components (c1) to (c3) is preferable, and a component that contains azaphthalides as the component (c1), bisphenol as the component (c2), and an ester of fatty acid and aliphatic alcohol as the component (c3) is more preferable.

The content of the colorant in the reversibly allochroic toner is preferably 5% by mass to 60% by mass, and more preferably 15% by mass to 50% by mass, based on the total amount of the toner (excluding an external additive which will be described later). If the content of the colorant is less than the preferable lower limit, sufficient chromogenic properties are not easily exhibited. If the content exceeds the preferable upper limit, fixability and fastness of an image easily deteriorate.

When the composition containing the components (c1) to (c3) is used as the colorant, it is preferable to use capsules containing the composition. If the capsules are used, it is possible to prevent the composition from being influenced by the chemical action of other raw materials of the toner.

If necessary, the reversibly allochroic toner according to the embodiment may contain other components in addition to the binder resin and the colorant. Examples of other components include a release agent, a surfactant, an aggregation agent, a charge control agent, an external additive, a basic compound, a pH regulator, and the like.

Examples of the release agent include aliphatic hydrocarbon-based wax such as low-molecular weight polyethylene, low-molecular weight polypropylene, a polyolefin copolymer, polyolefin wax, microcrystalline wax, paraffin wax, and Fischer-Tropsch wax; oxides of aliphatic hydrocarbon-based wax, such as polyethylene oxide wax; block copolymers of these; plant wax such as candelilla wax, carnauba wax, Japan tallow, jojoba wax, and rice wax; animal wax such as beeswax, lanolin, and spermaceti; mineral wax such as ozokerite, ceresine, and petrolactum; ester wax containing fatty acid ester as a main component, such as palmitic acid ester wax, montanoic acid ester wax, and castor wax; the wax obtained by deoxidizing a part or all of aliphatic acid ester, such as deoxidized carnauba wax; and the like.

One type of the release agent can be used by itself, or two or more types thereof can be used in combination.

Among the above release agents, the aliphatic hydrocarbon-based wax and the ester wax containing fatty acid ester as a main component are preferable since these have an excellent effect of suppressing the occurrence of offset. Among these, the aliphatic hydrocarbon-based wax is more preferable, and paraffin wax is particularly preferable.

The content of the release agent in the reversibly allochroic toner is preferably 3% by mass to 30% by mass, and more preferably 5% by mass to 20% by mass, based on the total amount of the toner (excluding an external additive which will be described later). If the content of the release agent is less than the preferable lower limit, offset properties become insufficient, and fixability is not easily secured. If the content exceeds the preferable upper limit, filming easily occurs.

The surfactant mainly functions as a dispersant for producing the toner. Examples of the surfactant include anionic surfactants such as a sulfuric ester salt, sulfonate, solfosuccinate, a phosphoric acid ester salt, a soap, and carboxylate; cationic surfactants such as an amine salt and a quaternary ammonium salt; nonionic surfactants such as a polyethylene glycol-based surfactant, an alkylphenol ethylene oxide adduct-based surfactant, and a polyol-based surfactant; and the like.

The aggregation agent is mainly used as an optional component for producing the toner, for the purpose of accelerating the aggregation of fine particles of the colorant, fine particles of the binder resin, and fine particles of the release agent which is used if necessary. Examples of the aggregation agent include metal salts such as sodium chloride, calcium chloride, calcium nitrate, barium chloride, magnesium chloride, zinc chloride, magnesium sulfate, aluminum chloride, aluminum sulfate, and potassium aluminum sulfate; non-metal salts such as ammonium chloride and ammonium sulfate; inorganic metal salt polymers such as polyaluminum chloride, polyaluminum hydroxide, and calcium polysulfide; polymeric aggregation agents such as polymethacrylic acid ester, polyacrylic acid ester, polyacrylamide, and an acrylamide-sodium acrylate copolymer; coagulants such as polyamine, poly diallyl ammonium halide, polydiallyl alkyl ammonium halide, a melamine formaldehyde condensate, and dicyandiamide; alcohols such as methanol, ethanol, 1-propanol, 2-propanol, 2-methyl-2-propanol, 2-methoxyethanol, 2-ethoxyethanol, and 2-butoxyethanol; organic solvents such as acetonitrile and 1,4-dioxane; inorganic acid such as hydrochloric acid and nitric acid; organic acid such as formic acid and acetic acid; and the like. Among these, non-metal salts are preferable, and ammonium sulfate is more preferable, since the agent has a strong aggregation accelerating effect.

The charge control agent is used to control chargeability of the toner and makes it easy for the toner to be transferred onto a recording medium such as paper. Examples of the charge control agent include metal-containing azo compounds, metal-containing salicylic acid derivative compounds, and the like. Among the metal-containing azo compounds, complexes or complex salts containing iron, cobalt, or chromium as a metal, or mixtures of these are preferable. Among the metal-containing salicylic acid derivative compounds, complexes or complex salts containing zirconium, zinc, chromium, or boron as a metal, or mixtures of these are preferable.

As the external additive, fine inorganic particles can be used to impart fluidity to the toner, regulate chargeability, or the like. Examples of the inorganic substance included in the fine inorganic particles include silica, titania, alumina, strontium titanate, tin oxide, and the like. One kind of the fine inorganic particles can be used singly, or two or more kinds thereof can be used in combination. Particularly, from the viewpoint of improving environmental stability, it is preferable to use the fine inorganic particles having undergone surface treatment with a hydrophobizing agent.

The average particle size of the reversibly allochroic toner according to the present embodiment is not particularly limited. The average particle size is preferably 4 μm to 15 μm, and more preferably 5 μm to 12 μm. If the average particle size of the toner is within the above preferable range, images can be easily and stably output.

In the present specification, the average particle size of the aggregates and the toner can be measured using a COULTER COUNTER. Moreover, the average particle size of each of the fine resin particles, fine colorant particles, and fine release agent particles can be measured using a laser diffraction-type particle size distribution analyzer.

The reversibly allochroic toner according to the first embodiment described so far contains a colorant that exhibits a hysteresis in a temperature-color state curve thereof. In addition, in the temperature-color state curve, the relationship of the following Formulae (1), (2), and (3) is satisfied.

$$Tr<T_{L2}<T_{L1}<T_{H1}<T_{H2}<Tg \quad \text{Formula (1)}$$

$$T_{H2}\leq 50^\circ\ C. \quad \text{Formula (2)}$$

$$20^\circ\ C.\leq Tr\leq 30^\circ\ C. \quad \text{Formula (3)}$$

Therefore, according to the reversibly allochroic toner according to the first embodiment, when the temperature change occurs at a temperature higher than 20° C. (temperature higher than the level close to room temperature, such as body temperature), the colorant in the first color state can easily change to the second color state, or the colorant in the second color state can easily change to the first color state. That is, a reversibly allochroic image is easily obtained. For example, it is possible to obtain an image that is in a state where it can reversibly switch between a chromogenic state and an achromatized state when a temperature change occurs at a temperature higher than 20° C.

When the temperature $T_{L2}$ becomes higher than 20° C. and keeps increasing, the image, which is formed of the reversibly allochroic toner according to the embodiment and was in the first color state, changes to the second color state. When the image is then left to cool, and the temperature decreases to be close to the room temperature (20° C. or lower), the image naturally returns to the first color state. Moreover, at the temperature close to the room temperature (20° C. or lower), the color state of the image does not change.

Furthermore, since the temperature $T_{H2}$ is 50° C. or lower, the color of the colorant does not change at the time of producing the toner or at the time of fixing the toner during the formation of the image. Accordingly, the temperature conditions do not need to be controlled. As a result, the productivity and operability of the toner are improved.

The reversibly allochroic toner according to the embodiment can be used for a nonmagnetic single-component developer or a two-component developer. The toner can be used for forming an image on an electrophotographic recording medium, by being loaded into an image forming apparatus such as Multi Function Peripheral (MFP). When the toner is used for a two-component developer, the usable carrier is not particularly limited and can be appropriately determined by those skilled in the art.

Second Embodiment

The second embodiment is a method of producing the reversibly allochroic toner according to the first embodiment.

The method of producing a reversibly allochroic toner according to the embodiment includes an aggregation step of obtaining aggregates by adding a resin dispersion that contains the binder resin to a colorant dispersion that contains the colorant.

Hereinafter, the method of producing a reversibly allochroic toner according to the embodiment will be described with reference to the drawings.

Figure 2:
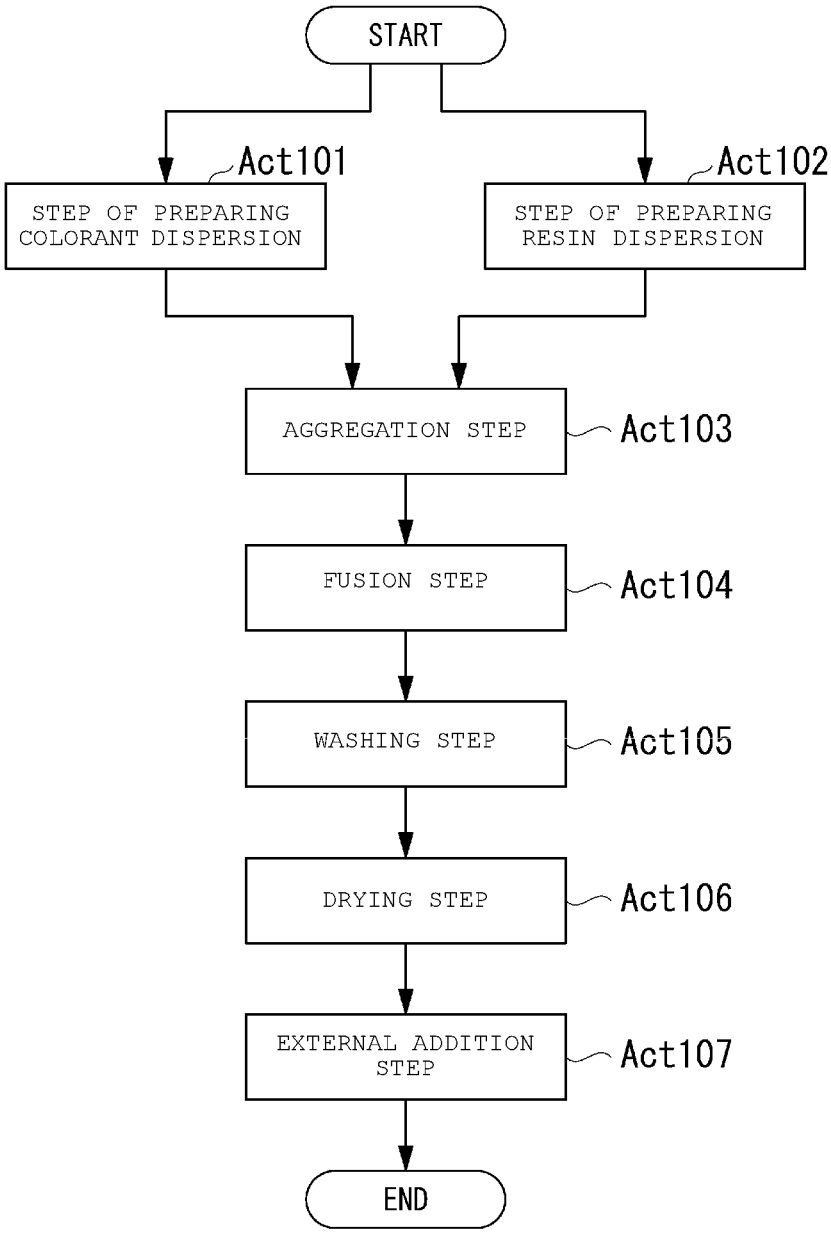
FIG. 2 shows one example of a method of producing a reversibly allochroic toner according to the embodiment.

FIG. 2 is a view schematically showing the method of producing the reversibly allochroic toner according to the embodiment. The method includes a step of preparing a colorant dispersion (Act101), a step of preparing a resin dispersion (Act102), an aggregation step (Act103), a fusion step (Act104), a washing step (Act105), a drying step (Act106), and an external addition step (Act107).

As the colorant, the binder resin, and components other than these that are mixed in the production method according to the present embodiment, the same colorant, binder resin, other components (a release agent, a surfactant, an aggregation agent, an external additive, a charge control agent, a basic compound, and a pH regulator) as described above are used.

Hereinafter, the step of preparing a colorant dispersion (Act101) will be described.

The colorant dispersion prepared in the present embodiment contains capsule particles that contain the composition containing the components (c1) to (c3). The colorant dispersion is prepared before the aggregation step is performed (Act101 of FIG. 2).

As the method of encapsulating the composition, known methods can be used. Examples of the methods include an interfacial polymerization method, a coacervation method, an in-situ method, a solvent evaporation method, and an orifice method, and the like. Among these methods of encapsulating the composition, an interfacial polymerization method is preferable since this makes it easy to obtain stable capsule particles.

For example, the composition may be encapsulated as below by the interfacial polymerization method. The components (c1) to (c3), a solution which is obtained by dissolving polyvalent isocyanate prepolymer as an encapsulating agent in an organic solvent (preferably, ester), and an aqueous solution of a water-soluble polymer compound or a surfactant are emulsified.

Thereafter, a base is added as a reactant to the obtained emulsion and mixed under heating. As the base added to the emulsion, water-soluble aliphatic modified amine is preferable.

A colorant dispersion in which the capsule particles containing the composition are dispersed, is prepared as above.

The average particle size of the capsule particles is preferably 0.5 μm to 30 μm, and more preferably 1 μm to 20 μm. If the average particle size of the capsule particles is equal to or greater than the preferable lower limit, sufficient chromogenic properties are easily exhibited. If the average particle size is equal to or smaller than the preferable upper limit, dispersion stability thereof in the toner is improved.

The capsule particles make the colorant reversibly switch between the first color state and the second color state in response to a temperature change, and exhibit a hysteresis in the temperature-color state curve thereof.

The concentration of the colorant (capsule particles) in the colorant dispersion is not particularly limited, and preferably 15% by mass to 40% by mass.

Hereinafter, the step of preparing a resin dispersion (Act102) will be described.

The resin dispersion prepared in the embodiment contains fine particles of the binder resin. The resin dispersion is prepared before the aggregation step is performed (Act102 of FIG. 2).

Examples of the dispersion medium in the resin dispersion include water, a mixed solvent including water and an organic solvent, and the like. Among these, water is preferable.

The resin dispersion may contain other components in addition to the binder resin and the dispersion medium. Examples of other components include a surfactant, a basic compound, and the like.

The resin dispersion can be prepared by, for example, mixing a solution, which is obtained by adding the binder resin and other components that are used if necessary to the dispersion medium, by applying mechanical shearing force. By the application of the mechanical shearing force, the binder resin can be atomized.

In the present specification, atomization means a process by which the particle size of a particle mixture in a dispersion is reduced compared to the particle size measured before the application of shearing force.

Examples of a mechanical shear apparatus that can be used to apply the mechanical shearing force include mechanical shear apparatuses not using media, such as ULTRA-TURRAX (manufactured by IKA JAPAN K.K.), TK AUTOHOMOMIXER (manufactured by PRIMIX Corporation), TK PIPELINE HOMO MIXER (manufactured by PRIMIX Corporation), TK FILMIX (manufactured by PRIMIX Corporation), CLEARMIX (manufactured by M Technique Co., Ltd.), CLEAR SS5 (manufactured by M Technique Co., Ltd.), CAVITRON (manufactured by EUROTEC CO., LTD.), FINE FLOW MILL (manufactured by Pacific Machinery & Engineering Co., Ltd.), MICROFLUIDIZER (manufactured by MIZUHO Industrial CO., LTD.), ULTIMIZER (manufactured by SUGINO MACHINE LIMITED), NANOMIZER (manufactured by Yoshida Kikai Co., Ltd.), GENUS PY (manufactured by Hakusuitech Co., Ltd.), and NANO3000 (manufactured by Beryu Corporation); and mechanical shear apparatuses using media, such as VISCOMILL (manufactured by AIMEX Corporation co., ltd.), APEX MILL (manufactured by KOTOBUKI INDUSTRIES CO., LTD.), STAR MILL (manufactured by Ashizawa Finetech Ltd.), DCP SUPERFLOW (manufactured by Nippon Eirich Co., Ltd.), MP MILL (manufactured by INOUE MFG., INC), SPIKE MILL (manufactured by INOUE MFG., INC), MIGHTY MILL (manufactured by INOUE MFG., INC), and SC MILL (manufactured by Mitsui Mining Co., Ltd.).

The average particle size of the fine particles of the binder resin contained in the resin dispersion is not particularly limited, and is preferably 0.05 μm to 0.50 μm. The shape of the fine particles of the binder resin is not particularly limited. For example, the fine particles of the binder resin may have the shape of a sphere, a cylinder, a plate, and the like. Particularly, it is preferable for the particles to have the shape of a sphere since the spherical particles can be more easily aggregated with the colorant (capsule particles).

The average particle size and shape of the fine particles of the binder resin can be controlled by regulating the mechanical shearing force applied by the mechanical shear apparatus.

The concentration of the binder resin in the resin dispersion is appropriately set according to the concentration and the like of the colorant, and is preferably 20% by mass to 40% by mass.

Hereinafter, the aggregation step (Act103) will be described.

In the aggregation step, the resin dispersion is added to the colorant dispersion. As a result, heteroaggregation occurs between the colorant (capsule particles) and the fine particles of the binder resin, whereby aggregates in which the surface of the capsule particles is covered with the fine particles of the binder resin are obtained. In the present specification, "heteroaggregation" means that the fine particles of the binder resin or release agent are aggregated with the capsule particles.

The aggregation step may be performed in a container that is generally used for an aggregation reaction. The reaction volume is appropriately set to various levels within a range of a laboratory scale to an industrial scale.

When the resin dispersion is added to the colorant dispersion, it is preferable to take time to add the resin dispersion little by little to the whole colorant dispersion. The resin dispersion may be continuously or intermittently added by a predetermined amount. Particularly, it is preferable to continuously add the resin dispersion by a predetermined amount. If the method of continuous addition is used, heteroaggregation more easily occurs between the colorant (capsule particles) and the fine particles of the binder resin. Furthermore, it is easy to obtain aggregates in which the surface of the capsule particles is sufficiently covered with the fine particles of the binder resin. In the case of the continuous addition, it is preferable to add the resin dispersion to the colorant dispersion at a constant addition speed. The addition speed is appropriately set according to the mixing scale or the like.

Before or after the resin dispersion is added to the colorant dispersion, if necessary, optional components may be added. Examples of the optional components include a surfactant, an aggregation agent, a charge control agent, and the like.

Hereinafter, the fusion step (Act104) will be described.

The fusion step according to the embodiment is a step of heating the aggregates obtained in the aggregation step. By the fusion step, the colorant (capsule particles) and the fine particles of the binder resin included in the aggregates are fused with each other, whereby fused particles are obtained. The fusion step may be simultaneously performed with the aggregation step.

The heating temperature of the aggregates is appropriately set. For example, the heating temperature of the aggregates is preferably between the glass transition temperature of the binder resin and the glass transition temperature +40° C. The heating time is preferably 2 to 10 hours.

Hereinafter, the washing step (Act105) will be described.

The washing step according to the embodiment is a step of washing the fused particles obtained after the fusion step. The washing step is performed appropriately by a known washing method. For example, the washing step is performed by repeatedly washing using deionized water and filtration. It is preferable for the washing step to be repeated until the conductivity of the filtrate becomes, for example, 50 μS/cm or less.

Hereinafter, the drying step (Act106) will be described.

The drying step according to the embodiment is a step of drying the fused particles obtained after the washing step. The drying step is performed appropriately by a known drying method. For example, the drying step is performed using a vacuum drier. It is preferable for the drying step to be performed until the moisture content of the fused particles becomes, for example, 1.0% by mass or less.

Hereinafter, the external addition step (Act107) will be described.

The external addition step according to the embodiment is a step of adding an external additive to the fused particles obtained after the drying step.

The external additive is optionally added for the purpose of imparting fluidity to the toner, adjusting chargeability, improving cleaning properties, and the like.

In the method of producing a reversibly allochroic toner, according to the second embodiment, the resin dispersion is added to the colorant dispersion in the aggregation step, whereby aggregates are obtained (aggregation step). In the aggregation step, the colorant (capsule particles) is sufficiently covered with the fine particles of the binder resin. Moreover, the colorant (capsule particles) included in the toner produced by the production method maintains its shape without being ground. Accordingly, according to the production method, the reversibly allochroic toner which reversibly switches between the first color state and the second color state in response to a temperature change, is stably produced.

Moreover, according to the production method, the colorant (capsule particles) is sufficiently covered with the fine particles of the binder resin. Consequently, the produced toner contains a small amount of the colorant particles, the particles in which the colorant is exposed in a large area, and the particles not containing the colorant. Therefore, if the toner produced by the production method is used, an excellent image is obtained.

In the method of producing a reversibly allochroic toner according to the second embodiment, when the release agent is mixed in as an optional component, it is preferable for the release agent to be added by a method in which it is added in the form of a dispersion during the aggregation step. The method makes it easy for fine particles of the release agent to adhere to the colorant (capsule particles).

The release agent dispersion contains fine particles of the release agent, and is prepared before the aggregation step is performed. Examples of the dispersion medium in the release agent dispersion include water, a mixed solvent including water and an organic solvent, and the like. Among these, water is preferable. The release agent dispersion may contain other components in addition to the release agent and the dispersion medium. Examples of other components include a surfactant, a basic compound, and the like.

The release agent dispersion can be prepared by, for example, mixing a solution, which is obtained by adding the release agent and other components that are used if necessary to the dispersion medium, by applying mechanical shearing force. By the application of the mechanical shearing force, the binder resin can be atomized.

Examples of a mechanical shear apparatus, which can be used for applying mechanical shearing force to atomize the release agent, include the same mechanical shear apparatuses as those which can be used for preparing the resin dispersion.

The average particle size of the fine particles of the release agent contained in the release agent dispersion is not particularly limited, and is preferably 0.10 μm to 1.0 μm. The shape of the fine particles of the release agent is not particularly limited. For example, the fine particles of the release agent may have the shape of a sphere, a cylinder, a plate, and the like. Particularly, it is preferable for the fine particles to have the shape of a sphere since the spherical particles are easily aggregated with the colorant (capsule particles).

The average particle size and shape of the fine particles of the release agent can be controlled by regulating the mechanical shearing force applied by the mechanical shear apparatus.

The concentration of the release agent in the release agent dispersion is appropriately set according to the concentration, type, and the like of the colorant, and is preferably 10% by mass to 30% by mass.

When the release agent dispersion is added to the colorant dispersion, it is preferable to take time to add the release agent dispersion little by little to the whole colorant dispersion. The release agent dispersion may be continuously or intermittently added by a predetermined amount. Particularly, it is preferable to continuously add the release agent dispersion by a predetermined amount. If the method of continuous addition is used, heteroaggregation more easily occurs between the colorant (capsule particles) and the fine particles of the release agent. Furthermore, it is easy to obtain aggregates in which the surface of the capsule particles is sufficiently covered with the fine particles of the release agent. In the case of the continuous addition, it is preferable to add the release agent dispersion to the colorant dispersion at a constant addition speed. The addition speed is appropriately set according to the mixing scale or the like.

Third Embodiment

A toner cartridge according to a third embodiment includes a container and the reversibly allochroic toner according to the first embodiment that is accommodated in the container. As the container, it is possible to use a container having the known form.

If printing is performed using the toner cartridge according to the third embodiment, an image formed with a toner that reversibly switches between the first color state and the second color state when a temperature change occurs at a temperature higher than 20° C., that is, a reversibly allochroic image, is easily obtained.

Fourth Embodiment

An image forming apparatus according to a fourth embodiment includes the body of the apparatus and the reversibly allochroic toner according to the first embodiment that is accommodated in the body. As the body of the apparatus, it is possible to use a general electrophotographic apparatus.

Figure 3:
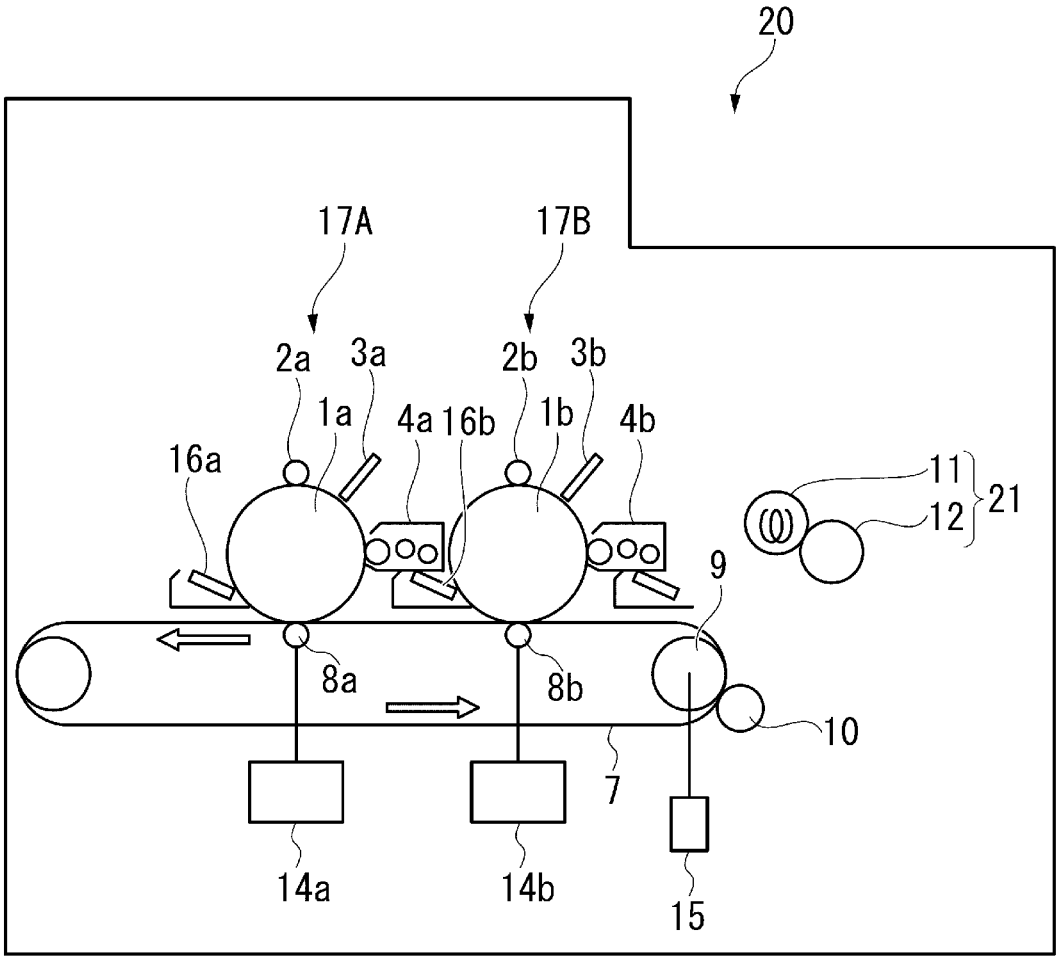
FIG. 3 is a schematic view showing an embodiment of an image forming apparatus.

FIG. 3 is a view schematically showing an example structure of the image forming apparatus according to the present embodiment.

As shown in the drawing, an image forming apparatus 20 has the body of the apparatus including an intermediate transfer belt 7, a first image forming unit 17A and a second image forming unit 17B that are disposed in this order on the intermediate transfer belt 7, and a fixing device 21 that is disposed in the downstream thereof. In the movement direction of the intermediate transfer belt 7, that is, in the direction in which the image forming process is performed, the first image forming unit 17A is positioned in the downstream of the second image forming unit 17B.

The first image forming unit 17A has a photoreceptor drum 1*a*, a cleaning device 16*a*, a charging device 2*a*, an exposure device 3*a*, and a first developing unit 4*a* that are disposed in this order on the photoreceptor drum 1*a*, and a primary transfer roller 8*a* that is disposed to face the photoreceptor drum 1*a* across the intermediate transfer belt 7.

The second image forming unit 17B has a photoreceptor drum 1*b*, a cleaning device 16*b*, a charging device 2*b*, an exposure device 3*b*, and a second developing unit 4*b* that are disposed in this order on the photoreceptor drum 1*b*, and a primary transfer roller 8*b* that is disposed to face the photoreceptor drum 1*b* across the intermediate transfer belt 7.

The first developing unit 4*a* and the second developing unit 4*b* accommodate the reversibly allochroic toner according to the first embodiment. The reversibly allochroic toner may be supplied from a toner cartridge not shown in the drawing.

The primary transfer roller 8*a* and primary transfer roller 8*b* are connected to primary transfer power sources 14*a* and 14*b* respectively.

In the downstream of the second image forming unit 17B, a secondary transfer roller 9 and a backup roller 10 are disposed such that the rollers face each other across the intermediate transfer belt 7. The secondary transfer roller 9 is connected to a secondary transfer power source 15.

The fixing device 21 has a heat roller 11 and a press roller 12 that are disposed to face each other.

By using the image forming apparatus 20 of FIG. 3, an image can be formed by, for example, the following method.

First, the photoreceptor drum 1*b* is evenly charged by the charging device 2*b*.

Next, exposure is performed by the exposure device 3*b*, whereby an electrostatic latent image is formed. Thereafter, the image is developed with the toner supplied from the second developing unit 4*b*, whereby a second toner image is obtained.

Subsequently, the photoreceptor drum 1*a* is evenly charged by the charging device 2*a*.

Next, based on first image information (second toner image), exposure is performed by the exposure device 3*a*, whereby an electrostatic latent image is formed. Thereafter, the image is developed with the toner supplied from the first developing unit 4*a*, whereby a first toner image is obtained.

The second toner image and the first toner image are transferred in this order onto the intermediate transfer belt 7 by the primary transfer rollers 8*a* and 8*b*.

The image that the second toner image and the first toner image are layered on the intermediate transfer belt 7 in this order, is transferred by secondary transfer onto a recording medium not shown in the drawing via the secondary transfer roller 9 and the backup roller 10. As a result, an image that the first toner image and the second toner image are layered on the recording medium in this order, is formed.

The type of colorant used for the toner in the first developing unit 4*a* and the second developing unit 4*b* is optionally selected. The image forming apparatus 20 shown in the drawing uses two developing units. However, depending on the type of toner used, the image forming apparatus may have three or more developing units.

According to the image forming apparatus according to the fourth embodiment, an image formed with a toner that reversibly switches between the first color state and the second color state when a temperature change occurs at a temperature higher than 20° C., that is, a reversibly allochroic image, is easily obtained.

According to at least one of the embodiments described above, the reversibly allochroic toner containing the colorant that exhibits a hysteresis in the temperature-color state curve thereof is used. Moreover, in the temperature-color state curve, the relationship of the following Formulae (1), (2), and (3) is satisfied.

$$Tr<T_{L2}<T_{L1}<T_{H1}<T_{H2}<Tg \quad \text{Formula (1)}$$

$$T_{H2}\leq 50^\circ\ C. \quad \text{Formula (2)}$$

$$20^\circ\ C.\leq Tr\leq 30^\circ\ C. \quad \text{Formula (3)}$$

Therefore, if an image is formed using the reversibly allochroic toner according to the embodiment, the image reversibly switches between the first color state and the second color state when a temperature change occurs at a temperature higher than 20° C. (temperature higher than the level close to room temperature, such as body temperature), that is, a reversibly allochroic image is easily obtained.

According to the reversibly allochroic toner according to the embodiment, it is possible to easily form an image, of which the color reversibly changes by heating or cooling and which changes its color very quickly in response to heating or cooling, on demand. The reversibly allochroic toner according to the present embodiment can be applied to various fields according to the purpose, such as learning, teaching, and toys.

The following examples describe an example according to the present embodiment. However, the present embodiment is not limited to the examples.

Hereinafter, the process of preparing a colorant dispersion (C-1) will be described.

2 parts by mass of 3-(4-diethylamino-2-hexyloxyphenyl)-3-(1-ethyl-2-methylindol-3-yl)-4-azaphthalide as the component (c1), 4 parts by mass of 1,1-bis(4-hydroxyphenyl) hexafluoropropane and 4 parts by mass of 1,1-bis(4-hydroxyphenyl)n-decane as the component (c2), and 50 parts by mass of palmitic acid-n-octyl as the component (c3) were evenly heated and dissolved.

Thereafter, 30 parts by mass of an aromatic polyvalent isocyanate prepolymer as an encapsulating agent and 40 parts by mass of ethyl acetate were added to and mixed with the resultant, thereby obtaining a solution. Next, the obtained solution was emulsified and dispersed in 300 parts by mass of a 8% by mass aqueous polyvinyl alcohol solution and continuously stirred at 80° C. for about 1 hour. Subsequently, 2.5 parts by mass of water-soluble aliphatic modified amine was added thereto as a reactant, and the resultant was continuously stirred for 6 hours, thereby obtaining colorless capsule particles. Thereafter, deionized water was added thereto, thereby obtaining a 27% by mass colorant dispersion (C-1).

As a result of measuring the obtained colorant dispersion (C-1) by using SALD-7000 (manufactured by Shimadzu Corporation), the volume average particle size (50% D) of the fine particles of the colorant was confirmed to be 3.0 μm.

In the colorant contained in the colorant dispersion (C-1), $T_{L2}$=27° C., $T_{L1}$=28° C., $T_{H1}$=33° C., and $T_{H2}$=34° C. Moreover, $\Delta T=T_{H1}-T_{L1}$=5° C.

Hereinafter, the process of preparing a colorant dispersion (C-2) will be described.

2 parts by mass of 3-(4-diethylamino-2-hexyloxyphenyl)-3-(1-ethyl-2-methylindol-3-yl)-4-azaphthalide as the component (c1), 4 parts by mass of 1,1-bis(4-hydroxyphenyl) hexafluoropropane and 4 parts by mass of 1,1-bis(4-hydroxyphenyl)n-decane as the component (c2), and 50 parts by mass of palmitic acid-n-heptyl as the component (c3) were evenly heated and dissolved.

Thereafter, 30 parts by mass of an aromatic polyvalent isocyanate prepolymer as an encapsulating agent and 40 parts by mass of ethyl acetate were added to and mixed with the resultant, thereby obtaining a solution. Next, the obtained solution was emulsified and dispersed in 300 parts by mass of a 8% by mass aqueous polyvinyl alcohol solution and continuously stirred at 80° C. for about 1 hour. Subsequently, 2.5 parts by mass of water-soluble aliphatic modified amine was added thereto as a reactant, and the resultant was continuously stirred for 6 hours, thereby obtaining colorless capsule particles. Thereafter, deionized water was added thereto, thereby obtaining a 27% by mass colorant dispersion (C-2).

As a result of measuring the obtained colorant dispersion (C-2) by using SALD-7000 (manufactured by Shimadzu Corporation), the volume average particle size (50% D) of the fine particles of the colorant was confirmed to be 3.0 μm.

In the colorant contained in the colorant dispersion (C-2), $T_{L2}$=28° C., $T_{L1}$=30° C., $T_{H1}$=33° C., and $T_{H2}$=34° C. Moreover, $\Delta T=T_{H1}-T_{L1}$=3° C.

Hereinafter, the process of preparing a colorant dispersion (C-3) will be described.

2 parts by mass of 3-(4-diethylamino-2-hexyloxyphenyl)-3-(1-ethyl-2-methylindol-3-yl)-4-azaphthalide as the component (c1), 4 parts by mass of 1,1-bis(4-hydroxyphenyl) hexafluoropropane and 4 parts by mass of 1,1-bis(4-hydroxyphenyl)n-decane as the component (c2), and 50 parts by mass of caprylic acid-4-benzyloxyphenyl ethyl as the component (c3) were evenly heated and dissolved.

Thereafter, 30 parts by mass of an aromatic polyvalent isocyanate prepolymer as an encapsulating agent and 40 parts by mass of ethyl acetate were added to and mixed with the resultant, thereby obtaining a solution. Next, the obtained solution was emulsified and dispersed in 300 parts by mass of a 8% by mass aqueous polyvinyl alcohol solution and continuously stirred at 80° C. for about 1 hour. Subsequently, 2.5 parts by mass of water-soluble aliphatic modified amine was added thereto as a reactant, and the resultant was continuously stirred for 6 hours, thereby obtaining colorless capsule particles. Thereafter, deionized water was added thereto, thereby obtaining a 27% by mass colorant dispersion (C-3).

As a result of measuring the obtained colorant dispersion (C-3) by using SALD-7000 (manufactured by Shimadzu Corporation), the volume average particle size (50% D) of the fine particles of the colorant was confirmed to be 3.0 μm.

In the colorant contained in the colorant dispersion (C-3), $T_{L2}$=−20° C., $T_{L1}$=0° C., $T_{H1}$=70° C., and $T_{H2}$=92° C. Moreover, $\Delta T=T_{H1}-T_{L1}$=70° C.

Hereinafter, the process of preparing a resin dispersion will be described.

As a binder resin, a polyester resin (acid value of 10 mg KOH/g, Mw of 15,000, and Tg of 58° C.) obtained by condensation polymerization of terephthalic acid and ethylene glycol was used.

30 parts by mass of the polyester resin, 1 part by mass of sodium dodecylbenzenesulfonate (manufactured by Kao Corporation, trade name: Neopelex G15) as an anionic surfactant, and 69 parts by mass of deionized water were mixed together, and pH thereof was regulated to be 12 by using potassium hydroxide, thereby preparing a dispersion. The dispersion was put in a high-pressure homogenizer NANO 3000 (manufactured by Beryu Corporation) and subjected to atomization at 150° C. under 150 MPa, thereby obtaining a resin dispersion.

As a result of measuring the obtained resin dispersion by using SALD-7000 (manufactured by Shimadzu Corporation), the volume average particle size (50% D) of the fine particles of the binder resin was confirmed to be 0.23 μm. The particles showed a sharp particle size distribution having a standard deviation of 0.15.

Hereinafter, the process of preparing a release agent dispersion will be described.

As a release agent, paraffin wax (manufactured by NIPPON SEIRO CO., LTD., trade name: HNP-3) having a melting point of 66° C. was used.

20 parts by mass of the paraffin wax, 1 part by mass of dipotassium alkenyl sulfosuccinate (manufactured by Kao Corporation, trade name: LATEMUL® ASK) as an anionic surfactant, and 79 parts by mass of deionized water were mixed together, thereby obtaining a dispersion. Thereafter, the obtained dispersion was put in a rotor and stator-type homogenizer Clearmix 2.2S (manufactured by M Technique Co., Ltd.) and heated to 80° C. under stirring at 5,000 rpm, thereby obtaining a release agent dispersion.

As a result of measuring the obtained release agent dispersion by using SALD-7000 (manufactured by Shimadzu Corporation), the volume average particle size (50% D) of the fine particles of the release agent was confirmed to be 0.50 μm.

FIG. 4 shows the composition f the colorant used for the toners according to the embodiments and comparative examples.

Example 1

42 parts by mass of the colorant dispersion (C-1) was mixed with 63 parts by mass of deionized water, and 50 parts by mass of a 30% by mass ammonium sulfate solution was added thereto under stirring, and the resultant was held as it was for 1 hour. Thereafter, 14 parts by mass of the release agent dispersion was continuously added thereto, and the resultant was heated to 30° C., thereby preparing a dispersion containing aggregates having a volume average particle size of 6.2 μm. Subsequently, 300 parts by mass of the resin dispersion of which the solid content concentration was set to 15% by mass was slowly and continuously added thereto over 10 hours, thereby obtaining an aggregate dispersion containing aggregates having a volume average particle size of 9.3 μm (coefficient of variation (CV) of 16.5).

Next, as a surfactant, 5 parts by mass of a polycarboxylic acid-based surfactant (manufactured by Kao Corporation, trade name: POIZ 520) was added to the aggregate dispersion containing aggregates having a volume average particle size of 9.3 μm. The resultant was then heated to 60° C. and left to standstill to cause fusion (fusion step).

Next, the dispersion containing the fused particles obtained as above was filtered and washed with deionized water repeatedly until the conductivity of the filtrate became 50 μS/cm (washing step).

Subsequently, the fused particles separated by the final filtration were dried with a vacuum drier until the moisture content became 1.0% by mass or less, thereby obtaining a dry toner (drying step).

The surface state of the dry toner was observed with an electron microscope. As a result, it was found that the capsule particles were sufficiently covered, and the toner had excellent surface properties.

As a result of measuring the dry toner by using a COULTER COUNTER MULTISIZER III (manufactured by Beckman Coulter, Inc.), the volume average particle size (50% D) of the dry toner was confirmed to be 10.0 μm.

Thereafter, 2 parts by mass of hydrophobic silica and 0.5 parts by mass of titanium oxide were added to the dry toner, and the resultant was mixed by a HENSCHEL-MIXER™_ (external addition step).

A toner of Example 1 was obtained as above.

The toner of Example 1 was mixed with ferrite carriers covered with a silicone resin, thereby preparing a developer. At this time, the ratio of the concentration of the ferrite carriers in the developer to the concentration of the toner was set to 8% by mass.

A toner cartridge containing the developer was installed in an electrophotographic multifunction machine (LOOPS LP30) manufactured by TOSHIBA TEC CORPORATION, and an image was output at a fixing temperature set to 95° C.

The image that was output was colorless. The image was then left at room temperature (25° C.), whereby the colorless image turned into a blue image. When the image portion of this image was pressed by a finger for several seconds, the blue image turned into a colorless image. Thereafter, the finger was separated from the image portion, and the image was left at room temperature (25° C.). As a result, as time elapsed, the colorless image slowly turned into a blue image.

Example 2

A dry toner was obtained in the same manner as in Example 1, except that the colorant dispersion (C-1) was replaced with the colorant dispersion (C-2).

As a result of measuring the dry toner by using a COULTER COUNTER MULTISIZER III (manufactured by Beckman Coulter, Inc.), the volume average particle size (50% D) of the dry toner was confirmed to be 10.0 μm.

Thereafter, 2 parts by mass of hydrophobic silica and 0.5 parts by mass of titanium oxide were added to the dry toner, and the resultant was mixed by a HENSCHEL-MIXER™ (external addition step).

A toner of Example 2 was obtained as above.

The toner of Example 2 was mixed with ferrite carriers covered with a silicone resin, thereby preparing a developer. At this time, the ratio of the concentration of the ferrite carriers in the developer to the concentration of the toner was set to 8% by mass.

A toner cartridge containing the developer was installed in an electrophotographic multifunction machine (LOOPS LP30) manufactured by TOSHIBA TEC CORPORATION, and an image was output at a fixing temperature set to 95° C.

The image that was output was colorless. The image was then left at room temperature (25° C.), whereby the colorless image turned into a blue image. When the image portion of this image was pressed by a finger for several seconds, the blue image turned into a colorless image. Thereafter, the finger was separated from the image portion, and the image was left at room temperature (25° C.). As a result, as time elapsed, the colorless image instantly turned into a blue image.

Comparative Example 1

A dry toner was obtained in the same manner as in Example 1, except that the colorant dispersion (C-1) was replaced with the colorant dispersion (C-3).

As a result of measuring the dry toner by using a COULTER COUNTER MULTISIZER III (manufactured by Beckman Coulter, Inc.), the volume average particle size (50% D) of the dry toner was confirmed to be 10.0 μm.

Thereafter, 2 parts by mass of hydrophobic silica and 0.5 parts by mass of titanium oxide were added to the dry toner, and the resultant was mixed by a HENSCHEL-MIXER™ (external addition step).

A toner of Comparative Example 1 was obtained as above.

The toner of Comparative Example 1 was mixed with ferrite carriers covered with a silicone resin, thereby preparing a developer. At this time, the ratio of the concentration of the ferrite carriers in the developer to the concentration of the toner was set to 8% by mass.

A toner cartridge containing the developer was installed in an electrophotographic multifunction machine (LOOPS LP30) manufactured by TOSHIBA TEC CORPORATION, and an image was output at a fixing temperature set to 85° C.

The image that was output was a blue image. When the image portion of the image was pressed by a finger for several seconds, the blue image did not undergo a color change.

The recording medium, on which the blue image had been printed, was passed through an eraser of the electrophotographic multifunction machine (LOOPS LP30) manufactured by TOSHIBA TEC CORPORATION, whereby the blue image turned into a colorless image.

Thereafter, the image was left at room temperature (25° C.), but the colorless image did not undergo a color change.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A reversibly allochroic toner comprising:

a binder resin; and a colorant, wherein the colorant reversibly switches between a first color state and a second color state in response to a temperature change, and the colorant exhibits a hysteresis in a temperature-color state curve thereof such that, when the colorant is in the first color state, and the temperature keeps increasing, when the temperature reaches a temperature $T_{H1}$ (° C.), the colorant starts to change from the first color state to the second color state, and in a temperature region in which the temperature is equal to or higher than a temperature $T_{H2}$ (° C.) which is higher than the temperature $T_{H1}$ (° C.), the colorant reversibly switches to the second color state, when the colorant is in the second color state, and the temperature keeps decreasing, when the temperature reaches a temperature $T_{L1}$ (° C.), the colorant starts to change from the second color state to the first color state, and in a temperature region in which the temperature is equal to or lower than a temperature $T_{L2}$ (° C.) which is lower than the temperature $T_{L1}$ (° C.), the colorant reversibly switches to the first color state, and the relationship of the following Formula is satisfied, $T_{H2}<Tg$, wherein Tg indicates a glass transition temperature of the binder resin, $T_{H2}<50°$ C., $T_{H1}-T_{L1}\leq 7°$ C., and $T_{L2}$ is greater than 20° C.

2. The toner according to claim 1, wherein $T_{H1}-T_{L1}\leq 3°$ C.

3. The toner according to claim 1, wherein $T_{H2}\leq 45°$ C.

4. The toner according to claim 1, wherein $T_{H2}\leq 40°$ C.

5. The toner according to claim 1, wherein:

a temperature Tr is a temperature that is lower than the temperatures $T_{L2}$, $T_{L1}$, $T_{H1}$, and $T_{H2}$, and $$20° \text{ C.}<Tr\leq 30° \text{ C.}$$

6. The toner according to claim 1, wherein the colorant comprises capsules containing a first component which is an electron-donating colorable organic compound, a second component which is an electron-accepting compound, and a third component which is a reaction medium controlling the color reaction between the first component and the second component.

7. The toner according to claim 6, wherein the third component is an ester of fatty acid and aliphatic alcohol.

8. The toner according to claim 1, wherein the colorant completely changes to the second color state in a temperature region in which the temperature is equal to or higher than a temperature $T_{H2}$, and wherein the colorant completely changes to the first color state in a temperature region in which the temperature is equal to or lower than a temperature $T_{L2}$.

9. A method of producing the reversibly allochroic toner of claim 1, comprising:

preparing a first dispersion of binder resin;

preparing a second dispersion of a colorant, wherein the colorant comprises capsules comprising a first component which is an electron-donating colorable organic compound, a second component which is an electron-accepting compound, and a third component which is a reaction medium controlling the color reaction between the first component and the second component;

adding the first dispersion to the second dispersion to aggregate particles of the binder resin and the colorant to form aggregates; and heating the aggregates to fuse particles of the binder resin and the colorant, wherein the colorant reversibly switches between a first color state and a second color state in response to a temperature change, and the colorant exhibits a hysteresis in a temperature-color state curve thereof such that, when the colorant is in the first color state, and the temperature keeps increasing, when the temperature reaches a temperature $T_{H1}$ (° C.), the colorant starts to change from the first color state to the second color state, and in a temperature region in which the temperature is equal to or higher than a temperature $T_{H2}$ (° C.) which is higher than the temperature $T_{H1}$ (° C.), the colorant reversibly switches to the second color state, when the colorant is in the second color state, and the temperature keeps decreasing, when the temperature reaches a temperature $T_{L1}$ (° C.), the colorant starts to change from the second color state to the first color state, and in a temperature region in which the temperature is equal to or lower than a temperature $T_{L2}$ (° C.) which is lower than the temperature $T_{L1}$ (° C.), the colorant reversibly switches to the first color state, and the relationship of the following Formula is satisfied, $T_{H2}<Tg$, wherein Tg indicates a glass transition temperature (° C.) of the binder resin, $T_{H2}<50°$ C., $T_{H1}-T_{L1}\leq 7°$ C., and $T_{L2}$ is greater than 20° C.

10. The method according to claim 9, wherein $T_{H1}-T_{L1}\leq 3°$ C.

11. The method according to claim 9, wherein $T_{H2}\leq 45°$ C.

12. The method according to claim 9, wherein $T_{H2}\leq 40°$ C.

13. The method according to claim 9, wherein:

a temperature Tr is a temperature that is lower than the temperature $T_{H2}$, and $$20° \text{ C.}\leq Tr\leq 30° \text{ C.}$$

14. The method according to claim 9, wherein the resin dispersion is continuously added to the colorant dispersion.

15. The method according to claim 9, wherein the third component is an ester of fatty acid and aliphatic alcohol.

16. The method according to claim 9, wherein the colorant completely changes to the second color state in a temperature region in which the temperature is equal to or higher than a temperature $T_{H2}$, and wherein the colorant completely changes to the first color state in a temperature region in which the temperature is equal to or lower than a temperature $T_{L2}$.

17. A toner cartridge comprising a toner that includes a binder resin and a colorant, wherein the colorant reversibly switches between a first color state and a second color state in response to a temperature change, and the colorant exhibits a hysteresis in a temperature-color state curve thereof such that, when the colorant is in the first color state, and the temperature keeps increasing, when the temperature reaches a temperature $T_{H1}$ (° C.), the colorant starts to change from the first color state to the second color state, and in a temperature region in which the temperature is equal to or higher than a temperature $T_{H2}$ (° C.) which is higher than the temperature $T_{H1}$ (° C.), the colorant reversibly switches to the second color state, when the colorant is in the second color state, and the temperature keeps decreasing, when the temperature reaches a temperature $T_{L1}$ (° C.), the colorant starts to change from the second color state to the first color state, and in a temperature region in which the temperature is equal to or lower than a temperature $T_{L2}$ (° C.) which is lower than the temperature $T_{L1}$ (° C.), the colorant reversibly switches to the first color state, and the relationship of the following Formula is satisfied, $T_{H2}<Tg$, wherein Tg indicates a glass transition temperature (° C.) of the binder resin, $T_{H2}<50°$ C., $T_{H1}-T_{L1}\leq 7°$ C., and $T_{L2}$ is greater than 20° C.

18. The toner cartridge according to claim 17, wherein $T_{H1}-T_{L1}\leq 3°$ C.

19. The toner cartridge according to claim 17, wherein $T_{H2}\leq 45°$ C.

20. The toner cartridge according to claim 17, wherein $T_{H2}\leq 40°$ C.

21. The toner cartridge according to claim 17, wherein:

a temperature Tr is a temperature that is lower than the temperatures $T_{L2}$, $T_{L1}$, $T_{H1}$, and $T_{H2}$, and $20° C.\leq Tr\leq 30°$ C.

22. The toner cartridge according to claim 17, wherein the colorant comprises capsules containing a first component which is an electron-donating colorable organic compound, a second component which is an electron-accepting compound, and a third component which is a reaction medium controlling the color reaction between the first component and the second component.

23. The toner cartridge according to claim 17, wherein the colorant completely changes to the second color state in a temperature region in which the temperature is equal to or higher than a temperature $T_{H2}$, and wherein the colorant completely changes to the first color state in a temperature region in which the temperature is equal to or lower than a temperature $T_{L2}$.

* * * * *